US008972155B2

(12) United States Patent
Nakamoto et al.

(10) Patent No.: US 8,972,155 B2
(45) Date of Patent: Mar. 3, 2015

(54) DEVICE AND METHOD FOR CONTROLLING START OF COMPRESSION SELF-IGNITION ENGINE

(75) Inventors: Yoshihisa Nakamoto, Hiroshima (JP); Takeo Yamauchi, Aki-gun (JP); Junichi Taga, Higashihiroshima (JP)

(73) Assignee: Mazda Motor Corporation, Hiroshima (JP)

( * ) Notice: Subject to any disclaimer, the term of this patent is extended or adjusted under 35 U.S.C. 154(b) by 389 days.

(21) Appl. No.: 13/594,648

(22) Filed: Aug. 24, 2012

(65) Prior Publication Data

US 2013/0074809 A1 Mar. 28, 2013

(30) Foreign Application Priority Data

Sep. 22, 2011 (JP) ..... 2011-207460

(51) Int. Cl.

| | |
|---|---|
| ***F02D 45/00*** | (2006.01) |
| ***F02D 41/26*** | (2006.01) |
| ***F02N 11/08*** | (2006.01) |
| ***F02N 19/00*** | (2010.01) |

(52) U.S. Cl.

CPC ..... *F02N 11/08* (2013.01); *F02N 19/00* (2013.01); *F02N 2019/002* (2013.01); *F02N 2300/2002* (2013.01)

USPC ..... 701/112; 701/103; 701/113; 123/179.4; 123/491

(58) Field of Classification Search

CPC . F02D 29/02; F02D 41/0025; F02D 41/0027; F02D 41/065; F02D 41/402; F02D 45/00; F02N 11/0814; F02N 11/0855; F02N 2019/008

USPC ..... 701/103, 112–114; 123/179.1, 123/179.3–179.5, 179.16, 299, 300, 305, 123/478, 480, 481, 491

See application file for complete search history.

(56) References Cited

U.S. PATENT DOCUMENTS

| | | | | |
|---|---|---|---|---|
| 2013/0080036 | A1* | 3/2013 | Yamauchi et al. | 701/112 |
| 2013/0080039 | A1* | 3/2013 | Nakamoto et al. | 701/113 |
| 2013/0096811 | A1* | 4/2013 | Yamauchi et al. | 701/112 |
| 2013/0138328 | A1* | 5/2013 | Shimo et al. | 701/104 |

FOREIGN PATENT DOCUMENTS

| | | |
|---|---|---|
| JP | 2009062960 | 3/2009 |

* cited by examiner

*Primary Examiner* — John Kwon
*Assistant Examiner* — Johnny H Hoang
(74) *Attorney, Agent, or Firm* — Alleman Hall McCoy Russell & Tuttle LLP

(57) ABSTRACT

A start control device includes a compression self-ignition engine, fuel injection valve, piston stop position detector, starter motor, and controller for stopping the engine when an automatic stop condition is satisfied, and thereafter, when a restart condition is satisfied and a compression-stroke-in-stop cylinder piston stop position is within a stop position range on a bottom dead center side, restarting the engine by injecting fuel into the compression-stroke-in-stop cylinder while applying torque to the engine. In restarting the engine, when the restart condition is not based on driver request, when the compression-stroke-in-stop cylinder piston stop position is within the stop position range, the controller restarts the engine, injecting fuel into an intake-stroke-in-stop cylinder on an intake stroke, when the cylinder reaches the compression stroke. When the restart condition is based on driver request, the controller restarts the engine, injecting fuel into the compression-stroke-in-stop cylinder.

5 Claims, 6 Drawing Sheets

DEVICE AND METHOD FOR CONTROLLING START OF COMPRESSION SELF-IGNITION ENGINE

BACKGROUND

The present invention relates to a start control device including a compression self-ignition engine for combusting a fuel injected into a cylinder by self-ignition. The start control device automatically stops the engine when a predetermined automatic stop condition is satisfied, and when a predetermined restart condition is satisfied, restarts the engine by injecting the fuel into a compression-stroke-in-stop cylinder that is on a compression stroke while the engine is stopped, while applying a torque to the engine by using a starter motor.

In recent years, compression self-ignition engines represented by a diesel engine have been widely familiarized as in-vehicle engines for reasons of their generally excellent thermal efficiency and less discharge amount of $CO_2$ compared to spark-ignition engines, such as gasoline engines.

For larger reduction of $CO_2$ in such compression self-ignition engines, it is effective to adopt the art of a so called idle stop control of automatically stopping the engine under, for example, an idle drive, and then automatically restarting the engine when, for example, a starting operation of the vehicle is performed, and various studies relating to this have been performed.

For example, JP2009-062960A discloses a control device of a diesel engine for automatically stopping the diesel engine when a predetermined automatic stop condition is satisfied, and when a predetermined restart condition is satisfied, restarting the diesel engine by injecting a fuel while applying a torque to the engine by driving a starter motor. Further, it is disclosed that a cylinder into which the fuel is injected first is changeably set based on a stop position of a piston of a cylinder that is on a compression stroke while an engine is stopped, in other words, when the engine stop is completed (compression-stroke-in-stop cylinder).

Further specifically, when the diesel engine is automatically stopped, a position of the piston of the compression-stroke-in-stop cylinder that is on the compression stroke at that time is determined, and it is determined whether the piston position is within a predetermined reference stop position range set relatively on a bottom dead center (BDC) side. When the piston position is within the reference stop position range, in restarting the engine, the fuel is injected into the compression-stroke-in-stop cylinder first, and on the other hand, when the piston position is on a top dead center (TDC) side of the reference stop position range, when the engine overall passes the TDC for the first time in the restart and an intake-stroke-in-stop cylinder (cylinder on intake stroke while the engine is stopped) reaches the compression stroke, the fuel is injected into the intake-stroke-in-stop cylinder.

According to such a configuration, when the piston of the compression-stroke-in-stop cylinder is within the reference stop position range, by injecting the fuel into the compression-stroke-in-stop cylinder, the fuel can surely self-ignite and the engine can promptly be restarted in a comparatively short time period (referred to as "the first compression start" for convenience). On the other hand, when the piston of the compression-stroke-in-stop cylinder is located on the TDC side of the reference stop position range, because a compression stroke amount (compression margin) is less and a temperature of air inside the cylinder does not rise sufficiently, a misfire may occur even when the fuel is not injected into the compression-stroke-in-stop cylinder. Therefore, in such a case, the fuel is injected into the intake-stroke-in-stop cylinder and not the compression-stroke-in-stop cylinder, and thereby, the air inside the cylinder is sufficiently compressed and the fuel can surely self-ignite (referred to as "the second compression start" for convenience).

As described above, conventionally, when restarting the engine, it is determined whether the piston of the compression-stroke-in-stop cylinder is stopped within the reference stop position range, and when the piston is stopped therein, the fuel is injected into the compression-stroke-in-stop cylinder and the engine is promptly restarted by the first compression start.

Meanwhile, the engine restart condition is broadly based on requirements from a driver and others. The requirement from the driver includes a starting operation of the vehicle, such as a disconnecting operation of clutches and a release operation of a brake. The requirements from others include the occurrence of necessities of restarting the engine for a systematic reason, such as a necessity of activating an air conditioner, a decrease in battery voltage, and a long automatic stop time period of the engine (referred to as "the systematic requirement" for convenience). When the engine is restarted by the starting requirement from the driver, the driver knows in advance that the engine is to be restarted. Therefore, even if vibrations occur due to the restart, a person on board does not feel greatly uncomfortable. On the other hand, when the engine is restarted by the systematic requirement, the driver does not know in advance that the engine is to be restarted. Therefore, if the vibrations occur due to the restart, the person on board feels greatly uncomfortable and an NVH (noise, vibration, and harshness) degrades significantly.

Further, according to the studies by the present inventors, it has been found that if the engine is always restarted by the first compression start when the stop position of the piston of the compression-stroke-in-stop cylinder is within the reference stop position range so as to shorten a restart time period (the time period from the start of driving the starter motor to a complete explosion of the engine), comparatively large vibrations occur in the restart comparatively more frequently. It is considered that the frequent vibrations are influenced by a resonant frequency of the vehicle depending on combinations of components, such as the engine, an engine mount, a transmission, and a chassis.

The present invention is made in view of the above situations, and allows, when restarting a compression self-ignition engine, a selection of prioritization between a prompt start and the NVH according to a restart condition of the engine. Thus the engine is always restarted in a most suitable mode, thereby improving a start control device of the compression self-ignition engine.

SUMMARY

According to one aspect of the invention, a start control device is provided. The device includes a compression self-ignition engine, a fuel injection valve for injecting fuel into a cylinder, a piston stop position detector for detecting a stop position of a piston, a starter motor for applying a rotational force to the engine, the engine combusting through a self-ignition, the fuel injected into the cylinder by the fuel injection valve, and a controller for automatically stopping the engine when a predetermined automatic stop condition is satisfied, and thereafter, when a predetermined restart condition is satisfied and the stop position of the piston of a compression-stroke-in-stop cylinder that is on a compression stroke while the engine is stopped is within a reference stop position range set relatively on a bottom dead center side, restarting the engine by injecting the fuel into the compression-stroke-in-stop cylinder while applying the rotational force to the engine by using the starter motor. In restarting the engine, when the restart condition is determined to be not based on a request from a driver, even when the stop position of the piston of the compression-stroke-in-stop cylinder is within the reference stop position range, the controller restarts the engine by injecting the fuel into an intake-stroke-in-stop cylinder that is on an intake stroke while the engine is stopped. When the cylinder reaches the compression stroke, on the other hand, and when the restart condition is determined to be based on the request from the driver, the controller restarts the engine by injecting the fuel into the compression-stroke-in-stop cylinder.

According to this aspect of the invention, in restarting the engine, even when the stop position of the piston of the compression-stroke-in-stop cylinder is within the reference stop position range (i.e., a first compression start is available), if the restart condition is satisfied by a systematic request and not by the start request from the driver, the engine is restarted by a second compression start. On the other hand, if the restart condition is satisfied by the start request from the driver, the engine is restarted by the first compression start.

As specifically described in the description of embodiments, a vibration generated in the restart is greatly influenced by a resonant frequency of the vehicle determined by combinations of components, such as the engine, an engine mount, a transmission, and a chassis. Although the resonant frequency is different in each vehicle, the difference is small, and in many kinds of vehicles, the resonant frequency generally settles at, for example, about 11±3 Hz.

Meanwhile, in the first compression start, the combustion starts when the engine overall reaches a top dead center for the first time (first compression) in the restart (first top dead center), and a torque for starting the engine is generated. The combustion is also caused when the engine overall reaches, for example, the top dead center the second time (second compression), the third time (third compression), with the torque being generated each time. The engine speed increases gradually due to the torque generation, and the generation interval of the torque gradually becomes shorter. In other words, the vibration frequency increases gradually. Further, the frequency settles in an idle state where the frequency is fixed. This is similar in the case of the second compression start. Note that, in the second compression start, when the engine overall reaches the first top dead center, only a drive force of the starter motor acts, and therefore, the torque by the first compression is relatively small. As a result, the engine speed between the first and second compressions becomes relatively slower, and the vibration frequency between the first and second compressions becomes lower than that in the first compression start. Then the torque due to the combustion is generated starting from the second compression, causing the engine speed to increase, and the vibration frequency to gradually increase. Further, similar to the first compression start, the frequency settles in the idle state where the frequency is fixed. Thus, in the first and second compression starts, the vibration frequencies in the early rotation stage (engine early rotation stage vibration frequencies), such as the first compression where the engine starts to rotate, the second compression, and the third compression, are different (although, the vibration frequencies are mostly the same near the idle state).

Further, according to the studies by the present inventors, it has been found that the engine early rotation state vibration frequency generated in the first compression start is closer to a resonant frequency of the vehicle (e.g., 11±3 Hz) than the engine early rotation state vibration frequency generated in the second compression start. Particularly, the vibration frequency between the first and second compressions in the first compression start is close to the resonant frequency. As a result, when restarting the engine in the first compression start, a phenomenon in which the vibration amplifies greatly easily occurs due to a resonant effect compared to when restarting the engine by the second compression start, and an NVH degrades significantly.

Thus, according to this aspect of the invention, when the engine is restarted by the systematic request and not by the request from the driver, even if the first compression start is available, because the engine is restarted by the second compression start, the great degradation of the NVH is avoided and a disadvantage that a person on board who does not know that the engine is to be restarted feels very uncomfortable is suppressed. Note that, in the second compression start, although a prompt starting performance degrades, because the driver has not issued the start request, the degradation of the prompt starting performance is not a major problem. On the other hand, when the engine is restarted by the start request from the driver, because the engine is restarted by the first compression start, the engine promptly starts in a short time period with good response to the start request from the driver. Note that, in the first compression start, although the NVH degrades, because the driver has issued the start request and knows in advance that the engine is to be restarted, the degradation of the NVH is not a major problem. According to an aspect of the invention, when restarting the compression self-ignition engine, according to the engine restart condition, the prioritization is selected between the prompt start and the NVH, and the engine is always restarted in a most suitable mode.

When the stop position of the piston of the compression-stroke-in-stop cylinder is on the bottom dead center side within the reference stop position range, the controller may set a fuel injection amount larger than that on the top dead center side within the reference stop position range to correspond to an air amount inside the compression-stroke-in-stop cylinder, and the controller may restart the engine by injecting the fuel with the amount set for the compression-stroke-in-stop cylinder regardless of whether the satisfied restart condition is based on the request from the driver.

According to this configuration, when the stop position of the piston of the compression-stroke-in-stop cylinder is on the dead bottom center side within the reference stop position range, regardless of the start request from the driver, the engine is always restarted by the first compression start.

As specifically described in the description of embodiments, the engine early rotation stage frequency generated in the first compression start mostly results from when the stop position of the piston of the compression-stroke-in-stop cylinder is on the top dead center side within the reference stop position range (e.g., between 102° CA and 108° CA before the compression top dead center). In other words, the stop position of the piston of the compression-stroke-in-stop cylinder has a strong tendency to settle between 102° CA and 108° CA before the compression top dead center. Therefore, when the stop position of the piston of the compression-stroke-in-stop cylinder is on the bottom dead center side within the reference stop position range (e.g., between 156° CA and 180° CA before the compression top dead center), by injecting the fuel with the amount which is set large to correspond to the air amount inside the cylinder, the torque increases, and the vibration frequency between the first and second compressions in the first compression start becomes closer to the engine early rotation stage vibration frequency generated in the second compression start, particularly to the vibration frequency between the second and third compressions in the second compression start.

Thus, according to this configuration, even if the engine is restarted by the first compression start, because the fuel injection amount is increased, the engine early rotation stage vibration frequency behaves closer to that in the second compression start, and the degradation of the NVH is suppressed. Therefore, even when the engine is restarted by the systematic request, the disadvantage that the person on board feels uncomfortable is suppressed. Further, when the engine is restarted by the start request from the driver, by restarting the engine by the first compression start, the advantage that the engine promptly starts in a short time period with good response is maintained. This configuration is particularly preferable to be applied to an early-close type engine where the intake valve is closed at or before an intake bottom dead center.

When the stop position of the piston of the compression-stroke-in-stop cylinder is on the bottom dead center side of a position corresponding to a closing timing of an intake valve within the reference stop position range, regardless of whether the satisfied restart condition is based on the request from the driver, the controller may restart the engine by injecting the same amount of fuel as the fuel injection amount that is set for restarting the engine by injecting the fuel into the compression-stroke-in-stop cylinder when the cylinder reaches the compression stroke.

According to this configuration, when the stop position of the piston of the compression-stroke-in-stop cylinder is on the bottom dead center side of the position corresponding to the closing timing of the intake valve (IVC timing) within the reference stop position range, regardless of the start request from the driver, the engine is always restarted by the first compression start.

As described above, the engine early rotation stage frequency generated in the first compression start is mostly from when the stop position of the piston of the compression-stroke-in-stop cylinder is on the top dead center side within the reference stop position range (e.g., between 102° CA and 108° CA before the compression top dead center). On the other hand, the position corresponding to the IVC timing is, for example, near 144° CA before the compression top dead center on the bottom dead center side of the range (e.g., between 102° CA and 108° CA before the compression top dead center) where the piston of the compression-stroke-in-stop cylinder has a strong tendency to settle. Therefore, when the stop position of the piston of the compression-stroke-in-stop cylinder is on the bottom dead center side of the position corresponding to the IVC timing within the reference stop position range (e.g., 162° CA before the compression top dead center), by injecting the same amount of fuel as that injected in the second compression start into the compression-stroke-in-stop cylinder, the torque increases, and the vibration frequency between the first and second compressions in the first compression start becomes closer to the engine early rotation stage vibration frequency generated in the second compression start, particularly to the vibration frequency between the second and third compressions in the second compression start.

Thus, according to this configuration, even if the engine is restarted by the first compression start, because the fuel injection amount is increased, the engine early rotation stage vibration frequency behaves closer to that in the second compression start, and the degradation of the NVH is suppressed. Therefore, even when the engine is restarted by the systematic request, the disadvantage that the person on board feels uncomfortable is suppressed. Further, when the engine is restarted by the start request from the driver, by restarting the engine by the first compression start, the advantage that the engine promptly starts in short time period with good response is executed. This configuration is particularly preferable to be applied to a late-close type engine where the intake valve is after the intake bottom dead center.

DETAILED DESCRIPTION OF THE EMBODIMENTS

(1) Overall Configuration of Engine

Figure 1:
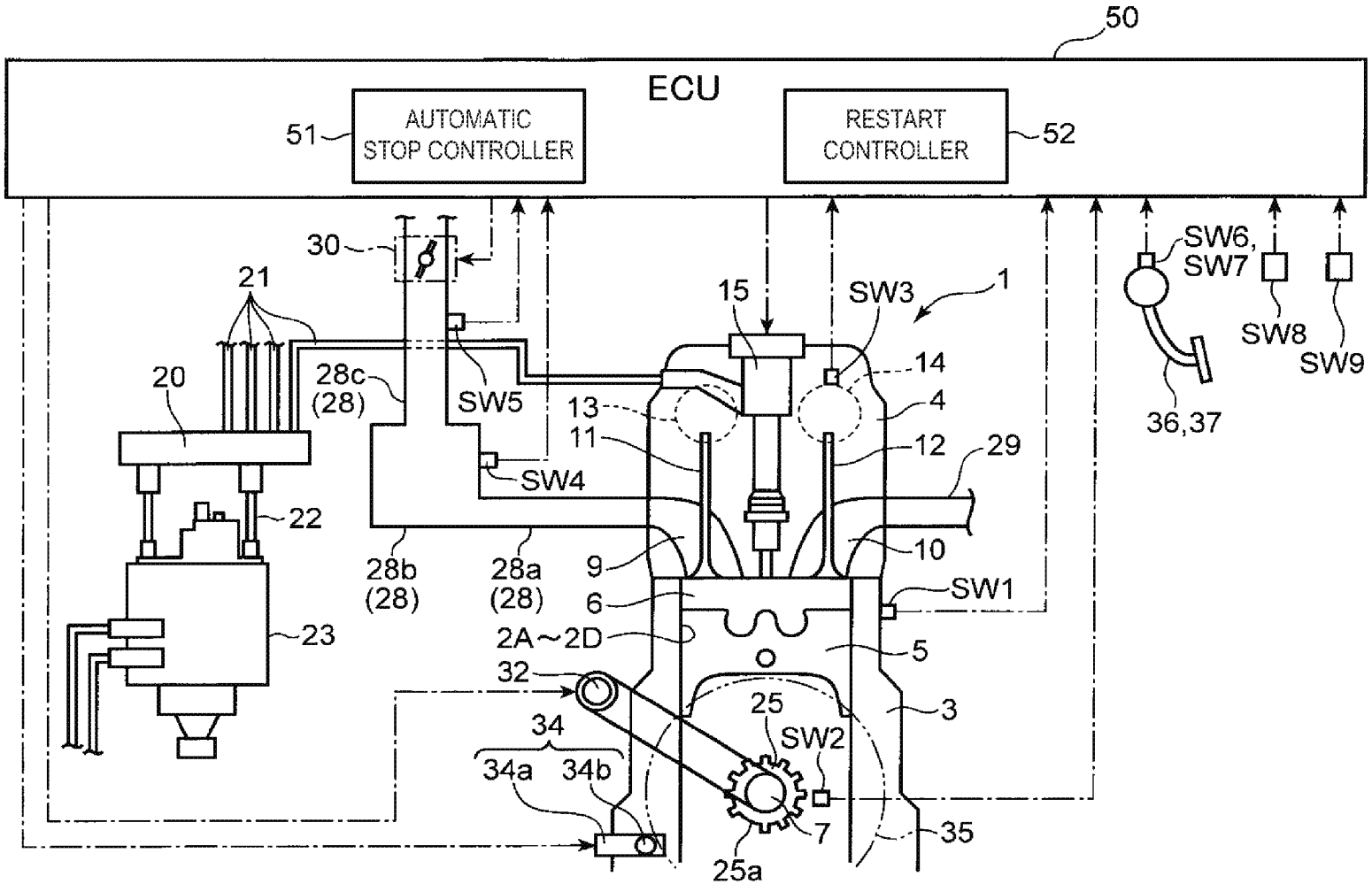
FIG. 1 is a systematic configuration diagram showing an overall configuration of a diesel engine applied with a start control device according to an embodiment of the invention.

FIG. 1 is a systematic configuration diagram showing an overall configuration of a diesel engine applied with a start control device according to an embodiment of the invention. The diesel engine shown in FIG. 1 is a four cycle diesel engine mounted in a vehicle as a power source for travel driving. An engine body 1 of the engine is an inline four cylinder type and includes a cylinder block 3 having four cylinders 2A to 2D aligning in a direction where the cylinders overlap with each other in FIG. 1, a cylinder head 4 disposed on the top of the cylinder block 3, and pistons 5 reciprocatably fitted into the cylinders 2A to 2D, respectively.

A combustion chamber 6 is formed above each piston 5, and each combustion chamber 6 is supplied with fuel (e.g., diesel fuel) injected from a fuel injection valve 15 (described later). Further, the injected fuel self-ignites in the combustion chamber 6 where temperature and pressure are high because of a compression operation by the piston 5 (i.e., a self-igniting compression), and the piston 5 is pushed down by an expansive force due to the combustion caused by the ignition and reciprocatably moves in a vertical direction.

Each piston 5 is coupled to a crankshaft 7 via a connecting rod (arranged outside the range of FIG. 1), and the crankshaft 7 rotates about its central axis according to the reciprocation movement (i.e. vertical movement) of the pistons 5.

Here, in the four-cycle four-cylinder diesel engine, the pistons 5 provided in the cylinders 2A to 2D vertically move with a phase difference of 180° in crank angle (180° CA). Therefore, combustion timing (i.e., fuel injection) in the cylinders 2A to 2D are set to vary the phase by 180° CA from each other. Specifically, when the cylinders 2A to 2D are numbered 1 to 4 in firing order, respectively, the combustion is performed in the order of the first cylinder 2A, the third cylinder 2C, the fourth cylinder 2D, and then the second cylinder 2B. Therefore, for example, when the first cylinder 2A is on an expansion stroke, the third cylinder 2C, the fourth cylinder 2D, and the second cylinder 2B are on a compression stroke, intake stroke, and exhaust stroke, respectively.

The cylinder head 4 is provided with intake and exhaust ports 9 and 10 opening into the combustion chambers 6 of the cylinders 2A to 2D, and intake and exhaust valves 11 and 12 for opening and closing the ports 9 and 10, respectively. Note that, the intake and exhaust valves 11 and 12 are opened and closed by valve operating mechanisms 13 and 14 that respectively include a pair of camshafts arranged in the cylinder head 4, in conjunction with the rotation of the crankshaft 7. The engine according to this embodiment is a late-closing type in which the intake valves 11 close after an intake bottom dead center (intake BDC).

Further, the cylinder head 4 is provided with one fuel injection valve 15 for each cylinder, and each fuel injection valve 15 is connected therewith via a common rail 20 serving as an accumulating chamber, and a branched tube 21. The common rail 20 is supplied with the fuel (e.g., diesel fuel) from a fuel supply pump 23 via a fuel supply tube 22 at high pressure, and the highly-pressurized fuel inside the common rail 20 is supplied to each fuel injection valve 15 via the branched tube 21.

Each fuel injection valve 15 comprises an electromagnetic needle valve provided in its tip with an injection nozzle formed with a plurality of holes, a fuel passage leading to the injection nozzle, and a needle valve body, electromagnetically operated for opening and closing the fuel passage, provided inside the fuel injection valve 15 (both not illustrated). Further, by driving the valve body in an opening direction by using the electromagnetic force obtained through a power distribution, the fuel supplied from the common rail 20 is directly injected from each hole of the injection nozzle into the combustion chamber 6.

The cylinder block 3 and the cylinder head 4 are formed therein with a water jacket (arranged outside the range of FIG. 1) where a coolant flows, and a water temperature sensor SW1 for detecting a temperature of the coolant inside the water jacket is formed in the cylinder block 3.

Further, a crank angle sensor SW2 for detecting a rotational angle and a rotational speed of the crankshaft 7 is provided in the cylinder block 3. The crank angle sensor SW2 outputs a pulse signal corresponding to the rotation of a crank plate 25 that rotates integrally with the crankshaft 7.

Specifically, multiple teeth aligned via a fixed pitch are convexly arranged in an outer circumferential part of the crank plate 25, and a tooth-lacking part 25*a* (i.e., the part with no tooth) for identifying a reference position is formed in a predetermined area of the outer circumferential part. Further, the crank plate 25 having the tooth-lacking part 25*a* at the reference position rotates and the pulse signal based thereon is outputted from the crank angle sensor SW2, and thus, the rotational angle (i.e., crank angle) and the rotational speed (i.e., engine speed) of the crankshaft 7 are detected.

On the other hand, the cylinder head 4 is provided with a cam angle sensor SW3 for detecting an angle of the camshaft for valve operation (not illustrated). The cam angle sensor SW3 outputs a pulse signal for cylinder determination corresponding to the transit of teeth of a signal plate for rotating integrally with the camshaft.

In other words, the pulse signal outputted from the crank angle sensor SW2 includes a no-signal portion generated every 360° CA corresponding to the tooth-lacking part 25*a*. Using only the information obtained from the no-signal portion, for example, while the piston 5 rises, the corresponding cylinder and the stroke between the compression stroke and exhaust stroke cannot be determined. Therefore, the pulse signal is outputted from the cam angle sensor SW3 based on the rotation of the camshaft that rotates once every 720° CA, and based on a timing of the signal output and a timing of the no-signal portion output from the crank angle sensor SW2 (i.e., transit timing of the tooth-lacking part 25*a*), the cylinder determination is performed.

The intake and exhaust ports 9 and 10 are connected with intake and exhaust passages 28 and 29, respectively. Thus, intake air (i.e., fresh air) from outside is supplied to the combustion chamber 6 via the intake passage 28 and exhaust gas (i.e., combusted gas) generated in the combustion chamber 6 is discharged outside via the exhaust passage 29.

In the intake passage 28, an area of a predetermined length upstream from the engine body 1 is defined as branched passage 28*a* respectively branched for each of the cylinders 2A to 2D, and upstream ends of the branched passage 28*a* are connected with a surge tank 28*b*. A single common passage 28*c* is formed upstream of the surge tank 28*b*.

The common passage 28*c* is provided with an intake throttle valve 30 for adjusting an air amount (i.e., an intake air amount) to flow into the cylinders 2A to 2D. The intake throttle valve 30 is basically kept fully opened or largely opened while the engine is in operation, and is closed to isolate the intake passage 28 as needed to stop the engine, for example.

An intake pressure sensor SW4 for detecting an intake pressure is provided to the surge tank 28*b* and an airflow sensor SW5 for detecting an intake airflow rate is provided to the common passage 28*c* between the surge tank 28*b* and the intake throttle valve 30.

The crankshaft 7 is coupled to an alternator 32 via, for example, a timing belt. The alternator 32 is built therein with a regulator circuit for controlling a current of a feed coil (arranged outside the range of FIG. 1) to adjust a power generation amount and obtain a drive force from the crankshaft 7 to generate a power based on a target value of the power generation amount (i.e., a target power generating current) determined based on, for example, an electrical load of the vehicle and a remaining level of a battery.

The cylinder block 3 is provided with a starter motor 34 for starting the engine. The starter motor 34 includes a motor body 34*a* and a pinion gear 34*b* rotatably driven by the motor body 34*a*. The pinion gear 34*b* is detachably matched with a ring gear 35 coupled to an end of the crankshaft 7. When starting the engine by the starter motor 34, the pinion gear 34*b* moves to a predetermined matching position to match with the ring gear 35 and a rotational force of the pinion gear 34*b* is transmitted to the ring gear 35, and thereby, the crankshaft 7 is rotationally driven.

(2) Control System

Each component of the engine configured as above is controlled overall by an electronic control unit (ECU) 50. The ECU 50 is a microprocessor comprising, for example, a CPC, a ROM, and a RAM that are well known, and corresponds to a controller in the claims.

The ECU 50 is inputted with various information from the various sensors. In other words, the ECU 50 is connected with the water temperature sensor SW1, the crank angle sensor SW2, the cam angle sensor SW3, the intake pressure sensor SW4, and the airflow sensor SW5 that are provided as parts of the engine, respectively. The ECU 50 acquires the various information including the temperature of the coolant of the engine, the crank angle, the engine speed, the cylinder determination result, the intake pressure, and the intake airflow rate, based on the input signals from the sensors SW1 to SW5.

Further, the ECU 50 is also inputted with information from various sensors (SW6 to SW9) provided to the vehicle. In other words, the vehicle is provided with an accelerator position sensor SW6 for detecting a position of an acceleration pedal 36 pressed by a driver, a brake sensor SW7 for detecting whether a brake pedal 37 is ON/OFF (i.e., the application of the brake), a vehicle speed sensor SW8 for detecting a traveling speed of the vehicle (i.e., vehicle speed), and a battery sensor SW9 for detecting the remaining level of the battery (not illustrated). The ECU 50 acquires the information including the accelerator position, the application of the brake, the vehicle speed, and the remaining level of the battery, based on the input signals from the sensors SW6 to SW9.

The ECU 50 controls the components of the engine respectively while performing various calculations based on the inputted signals from the sensors SW1 to SW9. Specifically, the ECU 50 is electrically connected with the fuel injection valve 15, the intake throttle valve 30, the alternator 32, and the starter motor 34, and outputs drive control signals to the components, respectively, based on the results of the calculations.

Next, the function of the ECU 50 is described in further detail. In normal operation of the engine, the ECU 50 has basic functions, such as, injecting a required amount of fuel based on operating conditions from the fuel injection valve 15, and generating a required amount of power based on, for example, the electrical load on the vehicle and the remaining level of the battery by the alternator 32. The ECU 50 also has functions to automatically stop the engine and restart the engine under predetermined conditions, respectively. Therefore, the ECU 50 has an automatic stop controller 51 and a restart controller 52 serving as functional elements regarding the automatic stop and restart controls of the engine.

During the operation of the engine, the automatic stop controller 51 determines whether the predetermined automatic stop conditions of the engine are satisfied, and when they are satisfied, the automatic stop controller 51 automatically stops the engine.

For example, when a plurality of conditions, such as, the vehicle is stopped, are all met and it is confirmed that it would not be disadvantageous to stop the engine, it is determined that the automatic stop conditions are satisfied. Thus, the engine is stopped by, for example, stopping the fuel injection from the fuel injection valve 15 (i.e., a fuel cut).

After the engine is automatically stopped, the restart controller 52 determines whether the restart condition is satisfied, and when it is satisfied, the restart controller 52 restarts the engine.

For example, when the engine is required to start, such as when the driver presses the acceleration pedal 36, the restart condition is determined to be satisfied. Thus, by restarting the fuel injection from the fuel injection valve 15 while applying the rotational force on the crankshaft 7 by driving the starter motor 34, the restart controller 52 restarts the engine.

(3) Automatic Stop Control

Next, an example of specific control operation of the automatic stop controller 51 of the ECU 50 controlling the engine automatic stop is described with reference to the flowchart in FIG. 2.

Figure 2:
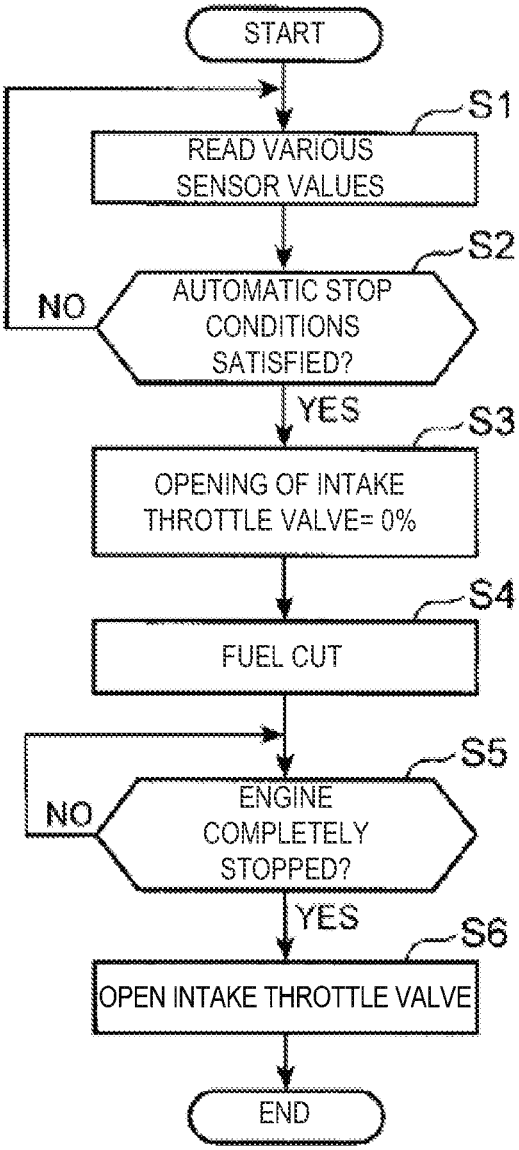
FIG. 2 is a flowchart showing an example of a specific operation of an automatic stop control of the engine.

When the processing shown in the flowchart in FIG. 2 starts, the automatic stop controller 51 reads various sensor values (Step S1). Specifically, the automatic stop controller 51 reads the detection signals from the water temperature sensor SW1, the crank angle sensor SW2, the cam angle sensor SW3, the intake pressure sensor SW4, the airflow sensor SW5, the accelerator position sensor SW6, the brake sensor SW7, the vehicle speed sensor SW8, and the battery sensor SW9, and based on these signals it acquires various information, such as the coolant temperature of the engine, the crank angle, the engine speed, the cylinder determination result, the intake air pressure, the intake airflow rate, the accelerator position, the brake position, the vehicle speed, and the remaining level of the battery.

Next, based on the information acquired by Step S1, the automatic stop controller 51 determines whether the automatic stop conditions of the engine are satisfied (Step S2). For example, the automatic stop conditions of the engine are determined to be satisfied when a plurality of conditions, such as the vehicle is stopped (i.e., vehicle speed=0 km/h), the opening of the acceleration pedal 36 is zero (i.e., accelerator OFF), the brake pedal 37 is in operation (i.e., brake ON), the coolant temperature is above the predetermined value (i.e., warmed-up state), and the remaining level of the battery is above a predetermined value are all satisfied. Note that, regarding the vehicle speed, the vehicle is not necessarily completely stopped (i.e., vehicle speed=0 km/h), and it may be below a low vehicle speed (e.g., below 3 km/h).

When it is confirmed that the automatic stop conditions are satisfied (Step S2: YES), the automatic stop controller 51 sets the opening of the intake throttle valve 30 to be fully closed (i.e., set to 0%) (Step S3). In other words, when the automatic stop conditions are satisfied, the opening of the intake throttle valve 30 is reduced from a predetermined opening, which is set during the idle drive, to fully closed (i.e., set to 0%).

Subsequently, the automatic stop controller 51 keeps the fuel injection valve 15 closed to stop the fuel supply from the fuel injection valve 15 (i.e., fuel cut) (Step S4).

Next, the automatic stop controller 51 determines whether the engine speed is 0 rpm to determine whether the engine is completely stopped (Step S5). Further, if the engine is completely stopped, the automatic stop controller 51 sets the opening of the intake throttle valve 30 to a predetermined opening (e.g., 80%) which is set in the normal operation (Step S6). Then the automatic stop control finishes.

(4) Restart Control and Operation and Effect of this Embodiment

Next, an example of specific control operation of the restart controller 52 of the ECU 50 controlling the engine restart is described with reference to the flowchart in FIG. 3.

Figure 3:
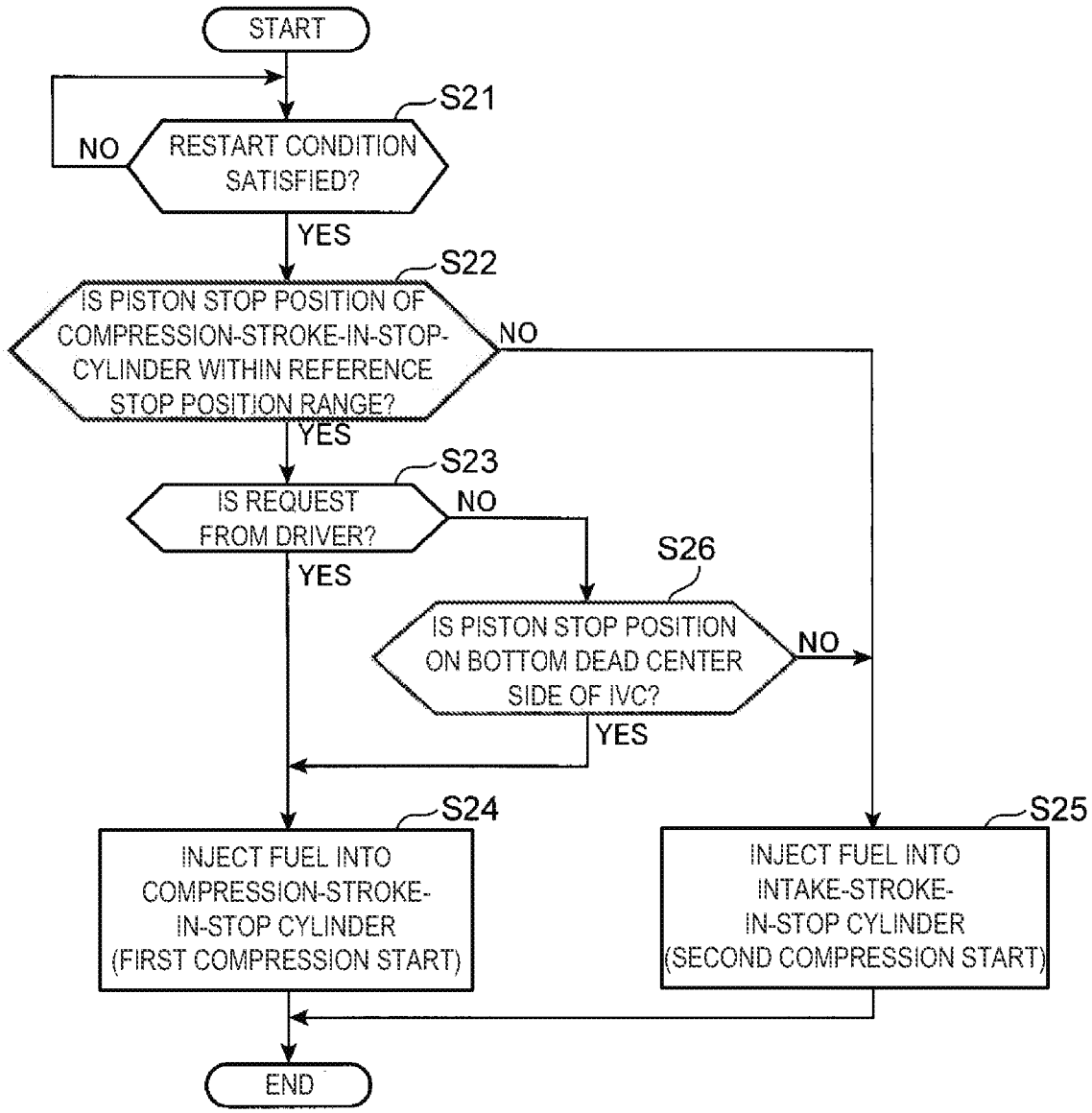
FIG. 3 is a flowchart showing an example of a specific operation of a restart control of the engine.

When the processing shown in the flowchart in FIG. 3 starts, the restart controller 52 determines whether the restart condition of the engine is satisfied based on the various sensor values (Step S21). For example, the restart condition of the engine is determined to be satisfied when at least one of the following conditions is satisfied: the acceleration pedal 36 is pressed to start the vehicle (i.e., accelerator ON); the remaining level of the battery is decreased; the coolant temperature of the engine is below a predetermined value (e.g., cold start); and the continuous stopped time period of the engine (i.e., the lapsed time period after the automatic stop) exceeds a predetermined time length. Here, the engine restart condition is broadly based on a start requirement from the driver (e.g., a starting operation of the vehicle, such as a disconnecting operation of clutches and/or a release operation of the brake) and a requirement from others (e.g., systematic reasons such as a necessity of activating an air conditioner, a decrease in battery voltage, and a long automatic stop time period of the engine).

When it is confirmed that the restart condition is satisfied (Step S21: YES), the restart controller 52 determines whether the piston stop position of the compression-stroke-in-stop cylinder (i.e., the cylinder that is on the compression stroke while the engine is stopped) is within the reference stop position range R (e.g., between 83° CA and 180° CA before a compression top dead center, TDC) based on the map shown in FIG. 4 (Step S22).

Here, the map is used when restarting the engine, to determine whether to reactivate the engine by the first compression start or the second compression start. The first compression start means restarting the engine by injecting the fuel into the compression-stroke-in-stop cylinder when the engine overall reaches the TDC for the first time in the restart (first TDC). The second compression start means restarting the engine by injecting the fuel into the compression-stroke-in-stop cylinder when the engine overall reaches the TDC for the second time in the restart (second TDC).

Figure 4:
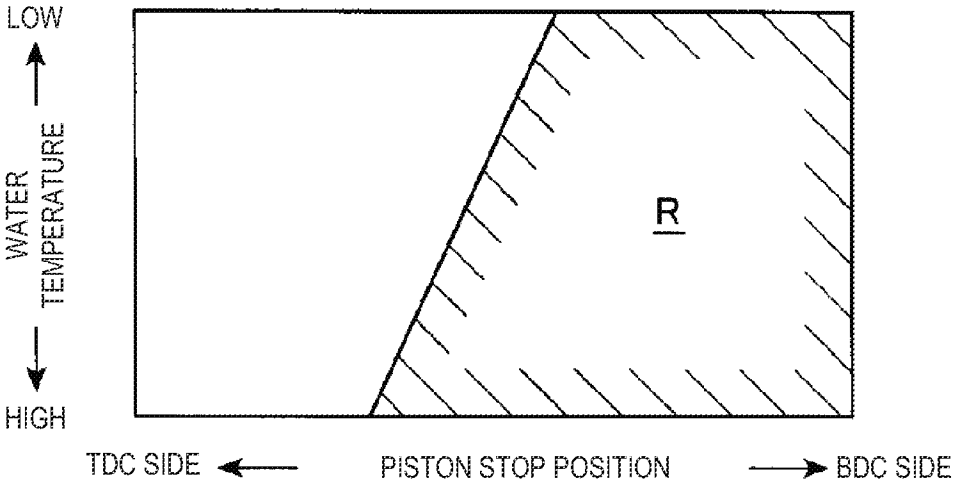
FIG. 4 is a map used to determine the restart control between a first compression start and a second compression start.

As shown in FIG. 4, in the determination map, the reference stop position range R is set by having the piston stop position of the compression-stroke-in-stop cylinder and the engine coolant temperature as parameters. Here, the engine coolant temperature in the vertical axis indicates the temperature when the engine restart control starts. In this embodiment, the phrase "when the engine restart control starts" means when it is confirmed that the restart condition is satisfied at Step S21.

As shown in FIG. 4, the reference stop position range R is set relatively on a dead bottom center (BDC) side, and expands toward the TDC side as the engine coolant temperature increases. In other words, if the engine coolant temperature when the restart control starts is relatively high, the piston stop position of the compression-stroke-in-stop cylinder highly likely enters the reference stop position range R compared to when the engine coolant temperature is relatively low.

When the piston stop position of the compression-stroke-in-stop cylinder is confirmed to be within the reference stop position range R (Step S22: YES), the restart controller 52 determines whether the restart condition that is confirmed to be satisfied at Step S21 is based on the requirement from the driver (Step S23).

As a result, when the satisfied restart condition is confirmed to be based on the requirement from the driver (Step S23: YES), the restart controller 52 restarts the engine by injecting the fuel into the compression-stroke-in-stop cylinder first (first compression start) (Step S24). In other words, by injecting the fuel into the compression-stroke-in-stop cylinder for self-ignition while driving the starter motor 34 to apply the rotational force to the crankshaft 7, the combustion restarts when the engine overall reaches the first TDC, and the engine is restarted. Then, the restart control finishes.

On the other hand, when the satisfied restart condition is confirmed to be not based on the requirement from the driver (Step S23: NO), in other words, based on the systematic requirement, the restart controller 52 restarts the engine by injecting the fuel into the intake-stroke-in-stop cylinder (i.e., the cylinder that is on the intake stroke while the engine is stopped) first (i.e., the second compression start) (Step S25). In other words, by injecting, while driving the starter motor 34 to apply the rotational force to the crankshaft 7, the fuel into the compression-stroke-in-stop cylinder for self-ignition when the engine overall passes the first TDC and the intake-stroke-in-stop cylinder reaches the compression stroke, the combustion restarts when the engine overall reaches the second TDC, and the engine is restarted. Then, the restart control finishes.

In other words, the start control device of the diesel engine (compression self-ignition engine) according to this embodiment includes the ECU 50 for automatically stopping the engine when the predetermined automatic stop conditions are satisfied, and then, if the stop position of the piston 5 of the compression-stroke-in-stop cylinder is within the reference stop position range R when the predetermined restart condition is satisfied, by injecting the fuel into the compression-stroke-in-stop cylinder while applying the rotational force to the engine by using the starter motor 34, the ECU 50 restarts the engine.

The following is a comparison of the first compression start and the second compression start. As shown in FIG. 4, the reference stop position range R is relatively predisposed toward the BDC side (e.g., between 83° CA and 180° CA before the compression TDC). If the piston 5 of the compression-stroke-in-stop cylinder is stopped at the position on the BDC side, when restarting the engine, by injecting the fuel into the compression-stroke-in-stop cylinder first (i.e., first in the entire engine), the engine can be restarted promptly and surely by the first compression start. In other words, if the piston stop position of the compression-stroke-in-stop cylinder is within the reference stop position range R, because a comparatively large amount of air exists in the compression-stroke-in-stop cylinder due to the rise of the piston 5 when restarting the engine, a compression stroke amount (i.e., a compression margin) by the piston 5 increases and the air inside the compression-stroke-in-stop cylinder is sufficiently compressed and increases its temperature. Therefore, when the fuel is injected into the compression-stroke-in-stop cylinder the first time in the restart, the fuel surely self-ignites inside the compression-stroke-in-stop cylinder and combusts.

On the other hand, if the piston 5 of the compression-stroke-in-stop cylinder is on the TDC side of the reference stop position range R, the compression stroke amount by the piston 5 becomes less and the temperature of the air inside the compression-stroke-in-stop cylinder does not increase sufficiently, and thus, a misfire may occur even if the fuel is injected into the compression-stroke-in-stop cylinder. Thus, in such a case, by injecting the fuel into the intake-stroke-in-stop cylinder and not the compression-stroke-in-stop cylinder, the air inside the intake-stroke-in-stop cylinder is sufficiently compressed and the fuel surely self-ignites (i.e., second compression start).

As above, when the piston 5 of the compression-stroke-in-stop cylinder is within the reference stop position range R, the engine can be restarted promptly by the first compression start. On the other hand, when the piston 5 is on the TDC side of the reference stop position range R, the fuel is required to be injected into the intake-stroke-in-stop cylinder in the second compression start, therefore, until the piston 5 of the intake-stroke-in-stop cylinder reaches near the compression TDC (i.e., until the engine overall reaches the second TDC), the self-ignition based on the fuel injection cannot be performed, and a restarting time period (in this embodiment, time period from the start of the starter motor 34 until the engine speed reaches 750 rpm) becomes long. Therefore, when restarting the engine, the engine is preferably restarted promptly by the first compression start.

However, in this embodiment, as described above, when restarting the engine, even if the stop position of the piston 5 of the compression-stroke-in-stop cylinder is within the reference stop position range R (i.e., even when the first compression start is available) (Step S22: YES), when the restart condition is satisfied by the systematic requirement and not by the starting requirement from the driver (Step S23: NO), the engine is started by the second compression start (Step S25). The reason for applying such a control operation is as follows.

Figure 5:
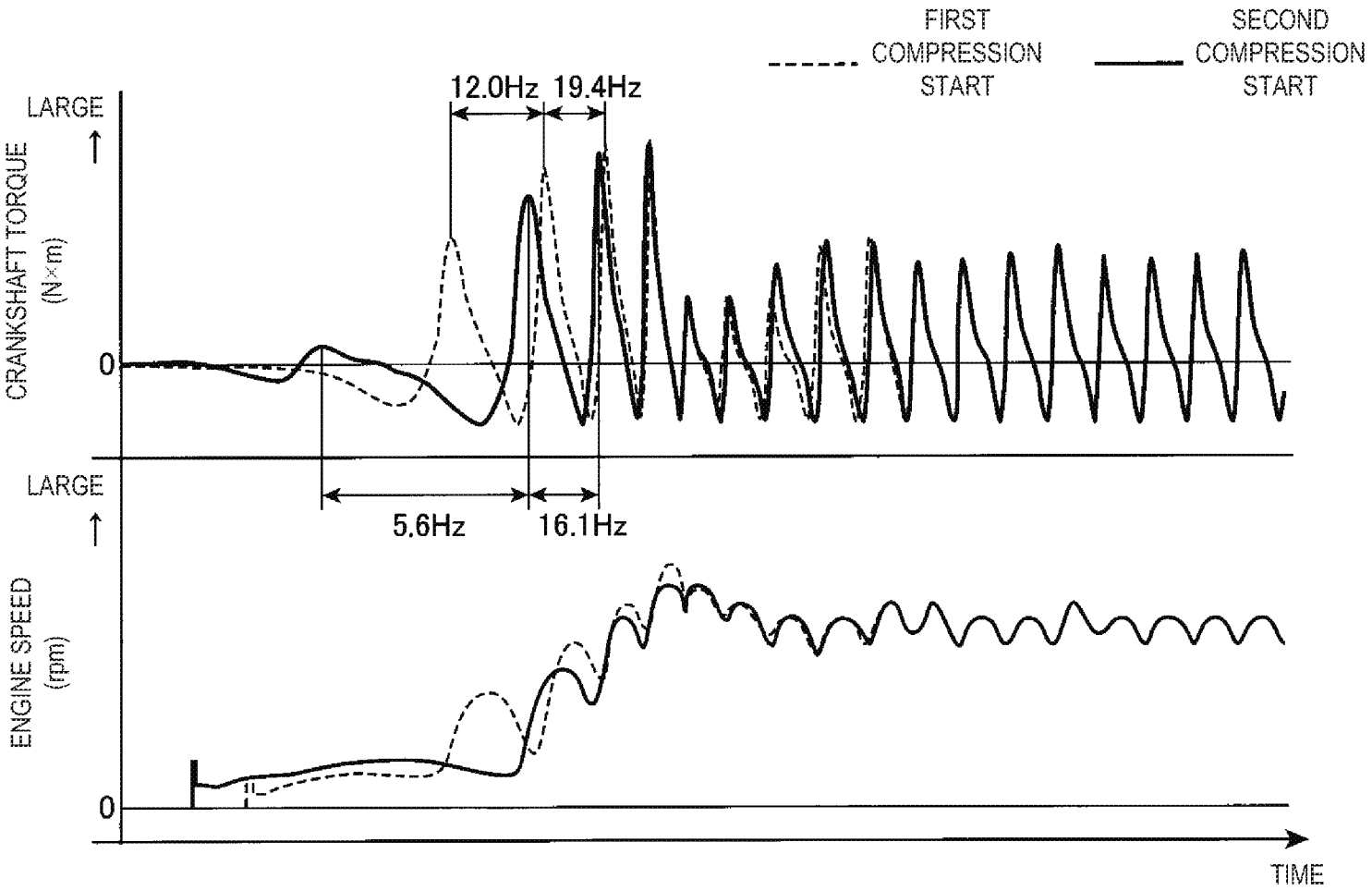
FIG. 5 is a time chart showing changes of a crankshaft torque and an engine speed when the engine is restarted by the first compression start and the second compression start.

FIG. 5 is a time chart showing changes of a crankshaft torque (N×m) and the engine speed (rpm) when the diesel engine according to this embodiment is restarted by the first compression start (broken line) and the second compression start (solid line). The stop position of the piston 5 of the compression-stroke-in-stop cylinder before the restart is 105° CA before the compression TDC in either case.

In the case of the first compression start (broken line), the combustion starts when the engine overall reaches the TDC in the first compression, and the torque for starting the engine is generated. The combustion is also caused when the engine overall reaches, for example, the second compression and/or third compression, and the torque is generated each time. The vibration frequency between the first and second compressions is 12.0 Hz, and the vibration frequency between the second and third compressions is 19.4 Hz.

In the case of the second compression start (solid line), the combustion starts when the engine overall reaches the second compression. When the engine overall reaches the first compression, only the drive force from the starter motor 34 acts on the crankshaft 7. Therefore, the torque from the first compression is smaller than the case of the first compression start. As a result, the engine speed between the first and second compressions becomes slower than the case of the first compression start, and the vibration frequency between the first and second compressions becomes 5.6 Hz, which is lower than that in the case of the first compression start (12.0 Hz). However, the vibration frequency, between second and third compressions where the torque by the combustion is generated, is 16.1 Hz, which is lower than that in the case of the first compression start (19.4 Hz) but higher than the vibration frequency between the first and second compressions by the first compression start (12.0 Hz).

Further, in either case, the engine speed gradually increases by the torque generation, the vibration frequency gradually increases, and the frequency settles in an idle state where the frequency is fixed. As above, in the first and second compression starts, the engine vibration frequencies in the early rotation stage (engine early rotation stage vibration frequencies), such as the first compression where the engine starts to rotate, the second compression, the third compression, are different.

On the other hand, the vibration generated in the restart is greatly influenced by a resonant frequency of the vehicle determined by combinations of components, such as the engine, an engine mount, a transmission, and a chassis. For example, if a power train where a transversely placed inline-four engine is coupled to a transmission or a differential device mounts on the chassis at three positions thereof, it is considered the roll vibration of the power train may be generated in starting the engine. Although the resonant frequency of the roll vibration is different in each vehicle, the difference is small, and in a vehicle with average performance, the resonant frequency generally settles at, for example, about 11±3 Hz (8 to 14 Hz) in both first and second compression starts.

In other words, in the engine early rotation stage vibration frequencies are generated in the first compression start, the vibration frequency between the first and second compressions (12.0 Hz) is close to or contained in the resonant frequency of a general vehicle (8 to 14 Hz). As a result, when the engine is restarted by the first compression start, a phenomenon in which the vibration amplifies greatly by the resonance easily occurs compared to when restarting the engine by the second compression start, and an NVH degrades significantly.

Thus, in this embodiment, when the engine is restarted by the systematic requirement and not by the requirement from the driver (Step S23: NO), the engine is restarted by the second compression start (Step S25) even if the first compression start is available (Step S22: YES). In this manner, the significant degradation of the NVH is avoided, and a disadvantage that a person on board who does not know that the engine is to be restarted feels very uncomfortable is suppressed.

Note that, in the second compression start, although a prompt starting performance degrades, because the driver has not issued a start request, the degradation of the prompt starting performance is not a major problem.

On the other hand, when the engine is restarted by the start request from the driver (Step S23: YES), because the engine is restarted by the first compression start (Step S24), the engine promptly starts in short time period with good response to the start request from the driver.

Note that, in the first compression start, although the NVH degrades, because the driver has issued the start request and knows in advance that the engine is to be restarted, the degradation of the NVH degradation is not a major problem.

Thus, in this embodiment, when restarting the compression self-ignition engine, according to the engine restart condition, the prioritization is selected between the prompt start by the first compression start and the NVH by the second compression start, and the engine is always restarted in a most suitable mode.

Note that, in this embodiment, if it is confirmed that the satisfied restart condition is based on the systematic request (Step S23: No in FIG. 3), the process proceeds to Step S26, and it is determined whether the piston stop position of the compression-stroke-in-stop cylinder is on the BDC side of the position corresponding to the closing timing of the intake valve 11 (IVC). Only when the result of the determination is no (i.e., the piston stop position of the compression-stroke-in-stop cylinder is on the TDC side of the position corresponding to the IVC timing), the process proceeds to Step S25 and the engine is started by the second compression start. In other words, when the piston position of the compression-stroke-in-stop cylinder is on the BDC side of the position corresponding to the IVC timing within the reference stop position range R (Step S26: YES), regardless of the start request from the driver (even when Step S23: No), the engine is always restarted by the first compression start (Step S24). The reason for applying such a control operation is as follows.

Figure 6:
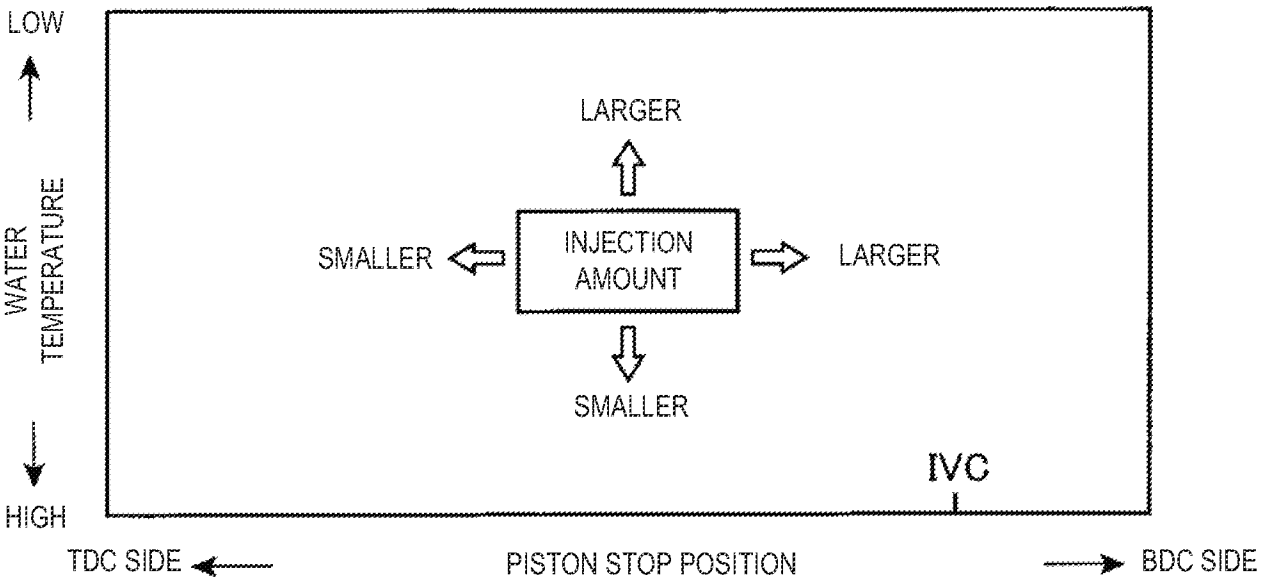
FIG. 6 is a map used to set a fuel injection amount injected into a cylinder in the restart control.

FIG. 6 is a map used to set the fuel injection amount injected into the cylinder in the restart control described above. In this embodiment, as shown in FIG. 6, the fuel injection amount injected into the cylinder in the restart control is set larger as the piston stop position is located further on the BDC side and as the engine coolant temperature is lower. This is a result of setting the fuel injection amount according to the air amount inside the cylinder determined by the piston stop position or according to the engine temperature. Note that, the fuel injection amount setting map illustrated in FIG. 6 can be used for the first compression start and the second compression start. Note that, the set value of the fuel injection amount is not effective within the range relatively on the TDC side that is outside the reference stop position range R in the case of the first compression start. Further, in the case of the second compression start, the fuel injection amount is set only for 180° CA before the compression TDC of an engine where the intake valve 11 closes early at or before the intake BDC, and the fuel injection amount is set only for the crank angle corresponding to the IVC timing (e.g., 144° CA before the compression TDC) for an engine where the intake valve 11 closes late after the intake BDC.

As shown in FIG. 6, the crank angle corresponding to the IVC timing (e.g., 144° CA before the compression TDC) is relatively on the BDC side. On the other hand, as described above, the data in FIG. 5 is obtained when the piston 5 of the compression-stroke-in-stop cylinder is stopped at 105° CA before the compression TDC where the piston 5 of the compression-stroke-in-stop cylinder tends to stop. In other words, as seen in FIG. 6, the fuel injection amount which is set when the piston stop position of the compression-stroke-in-stop cylinder is on the BDC side of the position corresponding to the IVC timing is relatively large, and the fuel injection amount which is set when the engine early rotation stage vibration frequency behaves as shown in FIG. 5 is relatively small.

Further, as described above, the engine according to the this embodiment is the late-closing type in which the intake valve 11 closes after the intake BDC. Therefore, in this embodiment, when the stop position of the piston 5 of the compression-stroke-in-stop cylinder is on the BDC side of the position corresponding to the IVC timing within the reference stop position range R (e.g., 162° CA before the compression TDC), even in the first compression start, the fuel injection amount is equal to the fuel injection amount set for the second compression start, and is set based on the fuel injection setting map in FIG. 6. Therefore, even in the first compression start, the amount of fuel injected into the compression-stroke-in-stop cylinder is equal to the amount of fuel injected in the second compression start. As a result, the torque increases, and the vibration frequency between the first and second compressions in the first compression start (12.0 Hz in FIG. 5) changes and becomes closer to the vibration frequency between the second and third compressions in the second compression start (16.1 Hz in FIG. 5).

Thus, when the piston stop position of the compression-stroke-in-stop cylinder is on the BDC side of the position corresponding to the IVC timing (Step S26: YES), even if the engine is restarted by the first compression start (Step S24), because the fuel injection amount is increased to the same level as the second compression start, the engine early rotation stage vibration frequency becomes close to the case of the second compression start, and the degradation of NVH is suppressed. Therefore, even when the engine restarts by the systematic request (Step S23: NO), the disadvantage that the person on board feels uncomfortable is suppressed, regardless of the start request from the driver (even when Step S23: NO), and the engine is always restarted by the first compression start (Step S24). Further, when the engine is restarted by the start request from the driver (Step S23: YES), by restarting the engine by the first compression start (Step S24), an advantage that the engine promptly starts in short time period with good response is executed.

(5) Other Embodiments

When the engine is an early-close type in which the intake valve 11 closes at or before the intake BDC, in the restart control shown in FIG. 3, when the stop position of the piston 5 of the compression-stroke-in-stop cylinder is on the BDC side within the reference stop position range R, in comparison to being on the TDC side, based on the fuel injection amount setting map illustrated in FIG. 6, the restart controller 52 may set the fuel injection amount larger corresponding to the air amount inside the compression-stroke-in-stop cylinder so that regardless of whether the satisfied restart condition is based on the request from the driver, the engine is restarted by injecting the fuel with the amount set for the compression-stroke-in-stop cylinder.

According to this configuration, when the stop position of the piston 5 of the compression-stroke-in-stop cylinder is on the BDC side within the reference stop position range R, regardless of the start request from the driver, the engine is always restarted by the first compression start. The reason for applying such a control operation is as follows.

As described above, the engine early rotation stage vibration frequency generated in the first compression start is mostly for when the stop position of the piston 5 of the compression-stroke-in-stop cylinder is on the TDC side within the reference stop position range R (e.g., between 102° CA and 108° CA before the compression TDC). Therefore, when the stop position of the piston 5 of the compression-stroke-in-stop cylinder is on the BDC side within the reference stop position range R (e.g., between 156° CA and 180° CA before the compression TDC), by injecting the fuel with the amount which is set large to correspond to the air amount inside the cylinder based on the fuel injection amount setting map illustrated in FIG. 6, the torque increases, and the vibration frequency between the first and second compressions in the first compression start (12.0 Hz in FIG. 5) changes and becomes closer to the vibration frequency between the second and third compressions in the second compression start (16.1 Hz in FIG. 5).

Thus, when the piston stop position of the compression-stroke-in-stop cylinder is on the BDC side, even if the engine is restarted by the first compression start, because the fuel injection amount is increased, the engine early rotation stage vibration frequency behaves closer to that in the second compression start, and the degradation of the NVH is suppressed. Therefore, even when the engine is restarted by the systematic request, the disadvantage that the person on board feels uncomfortable is suppressed. Thus, regardless of the start request from the driver, the engine is always restarted by the first compression start. Further, when the engine is restarted by the start request from the driver, by restarting the engine by the first compression start, the advantage that the engine promptly starts in short time period with good response is executed.

Further, in the above embodiment, when the automatic stop conditions are satisfied (Step S2: YES), the opening of the intake throttle valve 30 is fully closed (i.e., 0%) (Step S3), then, when the intake pressure is decreased to some extent, the fuel cut to stop the fuel injection from the fuel injection valve 15 is performed (Step S4); however, the fuel cut may be performed simultaneous to when the intake throttle valve 30 is fully closed.

Further, the above embodiment describes the example where the diesel engine (i.e., the engine that combusts the diesel fuel by self-ignition) is used, and the automatic stop and restart controls according to the above embodiment are applied to the diesel engine; however, the engine is not limited to the diesel engine, as long as it is a compression self-ignition engine. For example, recently, a homogeneous-charge compression ignition (HCCI) engine where the fuel containing gasoline self-ignites by being compressed at a high compression ratio has been studied and developed. The automatic stop and restart controls according to the above embodiment can suitably be applied also to such a compression self-ignition gasoline engine.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

DESCRIPTION OF REFERENCE CHARACTERS

2A to 2D Cylinder
5 Piston
15 Fuel Injection Valve
34 Starter Motor
50 ECU (Controller)
R Reference Stop Position Range

The invention claimed is:

1. A start control device, comprising:
a compression self-ignition engine;
a fuel injection valve for injecting fuel into a cylinder;
a piston stop position detector for detecting a stop position of a piston;
a starter motor for applying a rotational force to the engine, the engine combusting through a self-ignition, the fuel injected into the cylinder by the fuel injection valve; and
a controller for automatically stopping the engine when a predetermined automatic stop condition is satisfied, and thereafter, when a predetermined restart condition is satisfied and the stop position of the piston of a compression-stroke-in-stop cylinder that is on a compression stroke while the engine is stopped is within a reference stop position range set relatively on a bottom dead center side, restarting the engine by injecting the fuel into the compression-stroke-in-stop cylinder while applying the rotational force to the engine by using the starter motor,
wherein in restarting the engine, when the restart condition is determined to be not based on a request from a driver, even when the stop position of the piston of the compression-stroke-in-stop cylinder is within the reference stop position range, the controller restarts the engine by injecting the fuel into an intake-stroke-in-stop cylinder that is on intake stroke while the engine is stopped, when the cylinder reaches the compression stroke, and on the other hand, when the restart condition is determined to be based on the request from the driver, the controller restarts the engine by injecting the fuel into the compression-stroke-in-stop cylinder.

2. The device of claim 1, wherein when the stop position of the piston of the compression-stroke-in-stop cylinder is on the bottom dead center side within the reference stop position range, the controller sets a fuel injection amount larger than on a top dead center side within the reference stop position range to correspond to an air amount inside the compression-stroke-in-stop cylinder, and the controller restarts the engine by injecting the fuel with the amount set for the compression-stroke-in-stop cylinder regardless of whether the satisfied restart condition is based on the request from the driver.

3. The device of claim 1, wherein when the stop position of the piston of the compression-stroke-in-stop cylinder is on the bottom dead center side of a position corresponding to a closing timing of an intake valve within the reference stop position range, regardless of whether the satisfied restart condition is based on the request from the driver, the controller restarts the engine by injecting the same amount of fuel as the fuel injection amount that is set for restarting the engine by injecting the fuel into the compression-stroke-in-stop cylinder when the cylinder reaches the compression stroke.

4. The device of claim 2, wherein when the stop position of the piston of the compression-stroke-in-stop cylinder is on the bottom dead center side of a position corresponding to a closing timing of an intake valve within the reference stop position range, regardless of whether the satisfied restart condition is based on the request from the driver, the controller restarts the engine by injecting the same amount of fuel as the fuel injection amount that is set for restarting the engine by injecting the fuel into the compression-stroke-in-stop cylinder when the cylinder reaches the compression stroke.

5. A method of controlling a start of a compression self-ignition engine, comprising:
injecting fuel into a cylinder by a fuel injection valve;
detecting a stop position of a piston;
applying a rotational force to the engine by a starter motor;
combusting in the engine through a self-ignition, the fuel injected into the cylinder by the fuel injection valve; and
automatically stopping the engine when a predetermined automatic stop condition is satisfied, and thereafter, when a predetermined restart condition is satisfied and the stop position of the piston of a compression-stroke-in-stop cylinder that is on a compression stroke while the engine is stopped is within a reference stop position range set relatively on a bottom dead center side, restarting the engine by injecting the fuel into the compression-stroke-in-stop cylinder while applying the rotational force to the engine by using the starter motor,
wherein in restarting the engine, when the restart condition is determined to be not based on a request from a driver, even when the stop position of the piston of the compression-stroke-in-stop cylinder is within the reference stop position range, the engine is restarted by injecting the fuel into an intake-stroke-in-stop cylinder that is on intake stroke while the engine is stopped when the cylinder reaches the compression stroke, and on the other hand, when the restart condition is determined to be based on the request from the driver, the engine is restarted by injecting the fuel into the compression-stroke-in-stop cylinder.

* * * * *